US007007762B2

(12) United States Patent
Yamamoto

(10) Patent No.: US 7,007,762 B2
(45) Date of Patent: Mar. 7, 2006

(54) POWER TOOL

(75) Inventor: Hirokatsu Yamamoto, Anjo (JP)

(73) Assignee: Makita Corporation, Aichi-ken (JP)

( * ) Notice: Subject to any disclaimer, the term of this patent is extended or adjusted under 35 U.S.C. 154(b) by 66 days.

(21) Appl. No.: 10/328,760

(22) Filed: Dec. 23, 2002

(65) Prior Publication Data

US 2003/0121685 A1 Jul. 3, 2003

(30) Foreign Application Priority Data

Dec. 26, 2001 (JP) ..... 2001-403124

(51) Int. Cl.
*E21B 4/04* (2006.01)

(52) U.S. Cl. ..... 173/1; 173/216; 173/217

(58) Field of Classification Search ..... 173/1, 173/2, 11, 183, 216, 217; 318/254, 721, 318/722, 723, 432, 138, 439, 720, 724
See application file for complete search history.

(56) References Cited

U.S. PATENT DOCUMENTS

| | | | | | |
|---|---|---|---|---|---|
| 3,908,130 | A | * | 9/1975 | Lafuze | 290/46 |
| 4,072,888 | A | * | 2/1978 | Bechtle et al. | 318/685 |
| 4,316,512 | A | * | 2/1982 | Kibblewhite et al. | 173/183 |
| 4,455,514 | A | * | 6/1984 | Ohno | 318/254 |
| 4,546,293 | A | * | 10/1985 | Peterson et al. | 318/254 |
| 4,633,158 | A | | 12/1986 | Hirata et al. | 318/723 |
| 4,641,066 | A | * | 2/1987 | Nagata et al. | 318/254 |
| 4,922,169 | A | * | 5/1990 | Freeman | 318/254 |
| 5,115,174 | A | * | 5/1992 | Masuda et al. | 318/254 |
| 5,287,044 | A | * | 2/1994 | Izawa et al. | 318/254 |
| 5,298,839 | A | * | 3/1994 | Takeda | 318/254 |
| 5,360,073 | A | * | 11/1994 | Akazawa | 173/15 |
| 5,589,746 | A | * | 12/1996 | Lewis | 318/439 |
| 5,637,968 | A | * | 6/1997 | Kainec et al. | 318/432 |
| 5,701,065 | A | * | 12/1997 | Ishizaki | 318/701 |
| 5,982,133 | A | * | 11/1999 | Murakami et al. | 318/650 |
| 6,134,973 | A | * | 10/2000 | Schoeps | 73/862.23 |
| 6,239,567 | B1 | * | 5/2001 | Sunaga et al. | 318/432 |
| 6,424,798 | B1 | * | 7/2002 | Kitamine | 388/800 |
| 6,536,536 | B1 | * | 3/2003 | Gass et al. | 173/2 |
| 6,538,403 | B1 | * | 3/2003 | Gorti et al. | 318/254 |

FOREIGN PATENT DOCUMENTS

| | | |
|---|---|---|
| JP | 02-315434 | 7/1992 |
| JP | 09-326479 | 6/1999 |
| JP | 11-132628 | 11/2000 |

* cited by examiner

*Primary Examiner*—Louis K. Huynh
*Assistant Examiner*—Nathaniel Chukwurah
(74) *Attorney, Agent, or Firm*—Orrick, Herrington & Sutcliffe LLP

(57) ABSTRACT

It is an object of the present invention to provide a technique to increase efficiency of the output torque of the blushless motor to drive a power tool. A representative power tool may comprise a tool bit, a brushless motor to drive the tool bit, a battery to operate the brushless motor and a control device. The control device may operate the brushless motor by means of the battery. The control device may include an advance angle controlling section to control an advance angle of the brushless motor. According to the present teachings, the advance angle of the brushless motor may be determined based upon indexes that reflect working condition of the tool bit when the brushless motor is under the operation. By reflecting the working condition of the tool bit to the determination of the advance angle of the brushless motor, the brushless motor can be operated with higher efficiency under the various working condition such as a hard joint operation and a soft joint operation.

4 Claims, 6 Drawing Sheets

FIG. 5

191

Four Most Significant Bits as Battery Current

Four Least Significant Bits as Battery Voltage

| (V) \ (A) | | 1~3 (A) | 3~6 | 6~9 | 9~12 | 12~15 | 15~18 | ..... | 48~51 |
|---|---|---|---|---|---|---|---|---|---|
| | | 0 | 1 | 2 | 3 | 4 | 5 | ..... | F |
| 9~9.5 (V) | 0 | 2.7 | 5.1 | 7.2 | | | | | |
| 9.5~10 | 1 | 2.4 | 4.9 | | | | | | |
| 10~10.5 | 2 | 2.1 | | | | | | | |
| 10.5~11 | 3 | | | | | | | | |
| 11~11.5 | 4 | | | | | | | | |
| 11.5~12 | 5 | | | | | | | | |
| ⋮ | ⋮ | | | | | | | | |
| 16.5~17 | F | | | | | | | | |

POWER TOOL

BACKGROUND OF THE INVENTION

1. Field of the Invention

The present invention relates to a power tool driven by a brushless motor and, more particularly, to a technique that can maximize the output efficiency of the brushless motor in relation to the operation of the power tool.

2. Description of the Related Art

In tightening screws by utilizing a screwdriver, two types of operations as shown in FIGS. 8 and 9 are known. The operation type as shown in FIG. 8 is referred to as "hard joint" operation. To the contrary, the operation type as shown in FIG. 9 is referred to as "soft joint" operation. During the hard joint operation, the tool bit only rotates by a relatively small angle until the tightening operation is completed after the tool bit has contacted the work-piece. On the other hand, during the soft joint operation, tool bit rotates by a relatively large angle (the tool bit turns twice or more) until the tightening operation is completed.

The rotational angle of the tool bit during the hard joint operation is different from the rotational angle during the soft joint operation even if the power tool has the same torque condition for the both joints. As a result, the time required for continuously generating tightening torque until completion of the screw tightening operation becomes different between the hard joint operation and the soft joint operation. When the hard joint operation is selected, because the time required for tightening screws becomes relatively short, the inertia force of the rotating rotor can be additionally utilized for tightening the screw. On the other hand, when the soft joint operation is selected, time required for tightening the screw takes relatively long, and therefore, it is required to achieve stable tightening operation solely by means of the output torque of the motor without utilizing the inertia force of the rotor. As a result, energy efficiency to procure big torque in tightening screws should be maximized. Moreover, the output torque of the motor should be stabilized regardless of the type of operation to tighten the screw.

SUMMARY OF THE INVENTION

It is, accordingly, an object of the present teachings to provide a technique to increase efficiency of the output torque of the blushless motor to drive a power tool.

According to the present teachings, a representative power tool may comprise a tool bit, a brushless motor to drive the tool bit, a battery to operate the brushless motor and a control device. The control device may operate the brushless motor by means of the battery. The control device may include an advance angle controlling section to control an advance angle of the brushless motor. According to the present teachings, the advance angle of the brushless motor may be determined based upon indexes that reflect working condition of the tool bit when the brushless motor is under the operation. By reflecting the working condition of the tool bit to the determination of the advance angle of the brushless motor, the brushless motor can be operated with higher efficiency under the various working condition such as a hard joint operation and a soft joint operation.

Other objects, features and advantages of the present invention will be readily understood after reading the following detailed description together with the accompanying drawings and the claims.

BRIEF DESCRIPTION OF THE DRAWINGS

FIG. 5 shows an example of an advance angle mapping data.

DETAILED DESCRIPTION OF THE INVENTION

Figure 1:
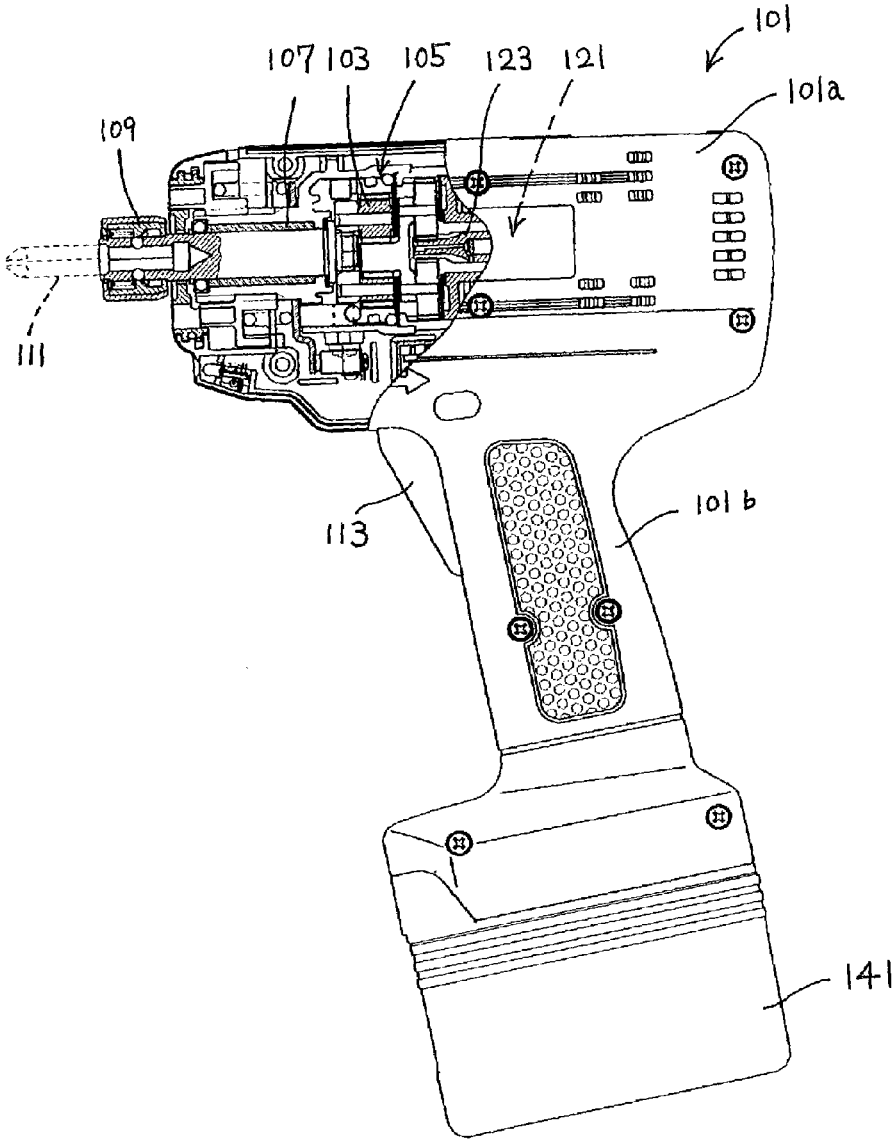
FIG. 1 is a partly broken-apart side view of the screwdriver according to the representative embodiment of the invention.

In accordance with the present teachings, representative power tool may include a tool bit, a brushless motor, a battery and a control device. The brushless motor may have a rotor. The brushless motor may drive the tool bit by rotation of the rotor. The battery may be detachably coupled to the power tool. The battery may provide direct current to the brushless motor. The control device may operate the brushless motor by means of the battery. Further, the control device may include an advance angle controlling section to control an advance angle of the brushless motor based upon indexes that reflect working condition of the tool bit when the brushless motor is under the operation.

As for the tool bit, any type of bits that can be mounted to the power tool may be embraced. For example, tool bit for drills, saws, grinders, impact drivers, impact wrenches, cutters, trimmers, circular saws, and reciprocating saws. Particularly, the present teachings may be preferably applied to tool bits utilized within a screwdriver, because the screw driver is required to output relatively high torque in tightening screws.

Preferably, the brushless motor may be adapted and arranged to include a permanent magnet in the rotor and a coil in the stator. Preferably, the battery may typically comprise a rechargeable battery which can be detachably coupled to the power tool. Preferably, the control device may typically control the electrical passage of current to coils of the respective phases of the DC brushless motor by means of a driving circuit so as to detect the position of the rotor of the DC brushless motor in order to rotate the rotor. In such case, the driving circuit may have transistors or FETs.

According to the present teachings, the advance angle may be determined based upon indexes that reflect working condition of the tool bit when the brushless motor is under the operation. The "advance angle" may be defined as the degree of the phase angle to be corrected such that the phase current (winding current) coincides with or approximates the phase of the induced voltage when the phase current (winding current) causes a phase delay with respect to the induced voltage due to the effects of the electrical time constant of the motor winding or other similar factors. Particularly in power tools, a range of variation of the output torque required for the operation may possibly become wider, and thus the motor power may easily increase. Therefore, the electrical time constant due to the effects of the resistance components and the coil components may increase, and particularly, the phase delay during high-power operation may often take place. Control of the advance angle is particularly effective against such phase delay. Specifically, the output efficiency of the DC brushless motor can be improved by controlling the advance angle based upon various factors, which affect the shift of the current phase of the DC brushless motor during operation, such as rotational speed of the motor, reaction torque applied from the workpiece onto the tool bit, battery voltage and current, temperature of the operating environment of the battery, and battery drain according to the frequency of use.

Preferably, the advance angle of the brushless motor may be determined based upon indexes relating to the battery voltage and current during operation of the brushless motor. The indexes may comprise those showing operating conditions of the tool. The "indexes relating to the battery voltage and current" are not only directly used as a parameter showing the battery voltage and current, but also widely include parameters correlating to the battery voltage and current, such as rotational speed of the tool, temperature of the work environment in which the battery is placed, and the degree of wear of the battery according to the frequency of use. Preferably, the advance angle may be reduced in response to the increase of the battery voltage during operation of the brushless motor, while the advance angle may be increased in response to the increase of the battery current.

By controlling the advance angle of the brushless motor based upon indexes relating to the battery voltage and current during operation of the brushless motor, accurate control of the advance angle can be achieved for the power tool that has a wider variation range of output torque. As a result, reduction of the output efficiency of the brushless motor can be minimized.

Further, the advance angle of the brushless motor may preferably be controlled based upon indexes relating to the battery voltage and current in each case of the brushless motor rotating in the forward direction and the reverse direction. In screwdrivers, for example, higher output torque is often required to loosen a screw which was incorrectly tightened. Due to such requirement for higher output torque, the winding current may possibly cause a phase delay with respect to the induced voltage. Therefore, it is useful to improve the output efficiency of the DC brushless motor by accurately controlling the advance angle.

Further, an advance angle map may preferably be provided which stores in the form of mapping data a plurality of pre-determined advance angles calculated based on the combination of the battery voltage and current. When such mapping data is utilized, the battery voltage and current (or indexes which reflect them) during operation of the DC brushless motor may be detected and then, an advance angle corresponding to the detected voltage and current can be easily determined from the mapping data. Thus, the advance angle can be controlled based upon the determined advance angle. In such case, it is not necessary to calculate an optimum advance angle in each time and therefore, control of the advance angles can be achieved with a simple construction.

Each of the additional features and method steps disclosed above and below may be utilized separately or in conjunction with other features and method steps to provide improved power tool and method for using such power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

As it is shown in FIG. 1, a screwdriver 101 may include a motor housing 101*a* and a grip 101*b*. The motor housing 101*a* may house a DC brushless motor 121, a motor drive shaft 123, a speed change mechanism 105 and a spindle 107. The speed change mechanism 105 mainly includes a planetary gear 103 in order to change the rotating speed of the motor drive shaft 123. A bit mounting chuck 109 and driver bit 111 are mounted to the front end of the spindle 107. The driver bit 111 is a feature that corresponds to "tool bit" according to the present teachings. A trigger switch 113 is provided on the upper end portion of the grip 101*b*. And a battery 141 is detachably mounted on the lower end portion of the grip 101*b*.

Figure 2:
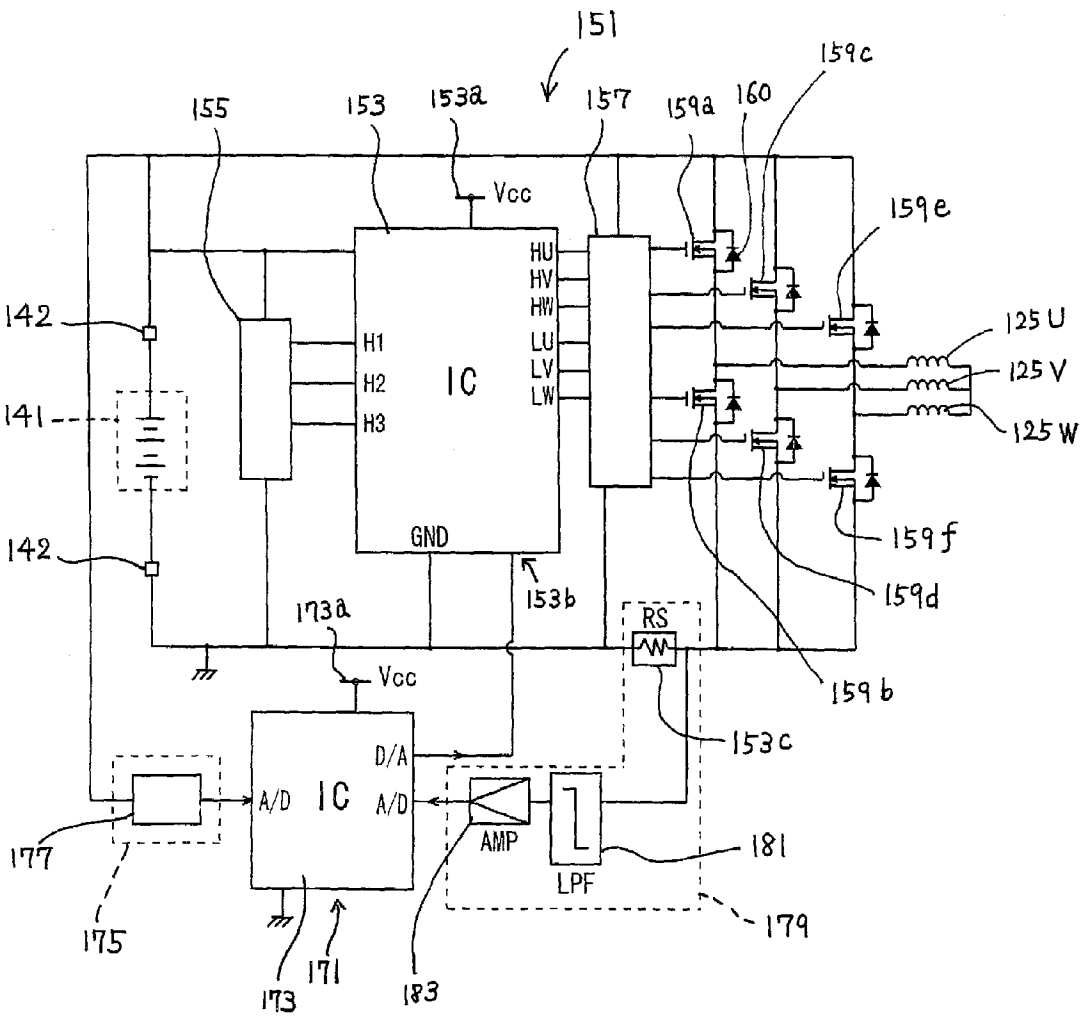
FIG. 2 shows the structure of the driving circuit of the brushless motor arranged within the representative embodiment.

The DC brushless motor 121 uses a three-phase bipolar driving circuit operated by means of direct current. Specifically, the DC brushless motor 121 may be drivingly controlled based upon 120° energizing rectangular wave by using three Y-connected rotor driving coils. FIG. 2 is a block diagram showing a representative driving circuit 151 for controlling the electric signals supplied to the DC brushless motor 121 to drive the motor by means of the battery 141. The driving circuit 151 is a feature that corresponds to the "control device" according to the present teachings.

The DC brushless motor driving circuit 151 is connected to the battery 141 via a connecting terminal 142. The driving circuit 151 may include a motor driving IC 153, position detecting circuit 155, gate drive circuit 157 and FETs (field-effect transistors) 159*a*, 159*b*, 159*c*, - - - 159*f* for the rectangular wave driving. According to this representative embodiment, six FETs in total are provided. Three coils (armature winding) 125U, 125V, 125W of the DC brushless motor 121 are connected to the FETs 159*a*–159*f*. The motor driving IC 153 is connected to the battery 141 and outputs voltage Vcc at 153*a* as shown in FIG. 2 in order to operate an advance angle determining IC 173.

A circulation diode 160 is arranged in antiparallel to each of the respective FETs 159*a*–159*f* in order to prevent the device from being damaged due to counter-electromotive force that may possibly be generated when each of the FETs 159*a*–159*f* is turned off.

Position detecting circuit 155 may include Hall elements. The position detecting circuit 155 detects the rotating position of a rotor 127 (see FIG. 3) of the DC brushless motor 121. Moreover, the position detecting circuit 155 outputs a rotor position signal to change the phase sequence in supplying the motor driving signals to the respective coils 125U, 125V, 125W in accordance with the respective phases (energizing start timing). Gate drive circuit 157 controls the energizing of the coils 125U, 125V, 125W by selectively applying a voltage to the respective gates of the FETs 159*a*–159*f*.

Specifically, by such selective voltage application to the respective gates of the FETs 159*a*–159*f*, the following drive controls are performed sequentially, so that the rotor 127 of the DC brushless motor 121 makes one full turn.

First, upon application of the gate voltages of the FETs 159*a* and 159*f*, current is passed from the coil 125U to the coil 125W.

Second, upon application of the gate voltages of the FETs 159*c* and 159*f*, current is passed from the coil 125V to the coil 125W.

Third, upon application of the gate voltages of the FETs 159*c* and 159*b*, current is passed from the coil 125V to the coil 125U.

Fourth, upon application of the gate voltages of the FETs 159*b* and 159*e*, current is passed from the coil 125W to the coil 125U.

Fifth, upon application of the gate voltages of the FETs 159*d* and 159*e*, current is passed from the coil 125W to the coil 125V.

Sixth, upon application of the gate voltages of the FETs 159*a* and 159*d*, current is passed from the coil 125U to the coil 125V.

Figure 3:
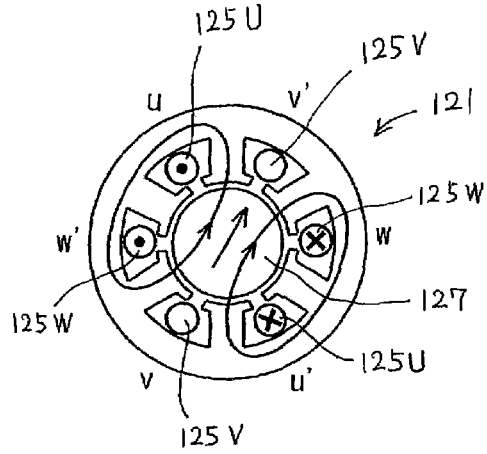
FIG. 3 shows an example of commutation in the brushless motor used within the representative embodiment.

As an example, FIG. 3 shows the structure of the DC brushless motor 121 when current has been passed from the coil 125U to the coil 125W by application of the gate voltages of the FETs 159*a* and 159*f*.

As shown in FIG. 2, an advance angle determining section 171 may include an advance angle determining IC 173, a battery voltage detecting section 175 and a battery current detecting section 179. The battery voltage detecting section 175 comprises a potentiometer 177 which is connected to the DC brushless motor driving circuit 151. The battery current detecting section 179 comprises a shunt resistance 153*c* disposed on the DC brushless motor driving circuit 151, a low pass filter 181 and an amplifier 183.

Figure 4:
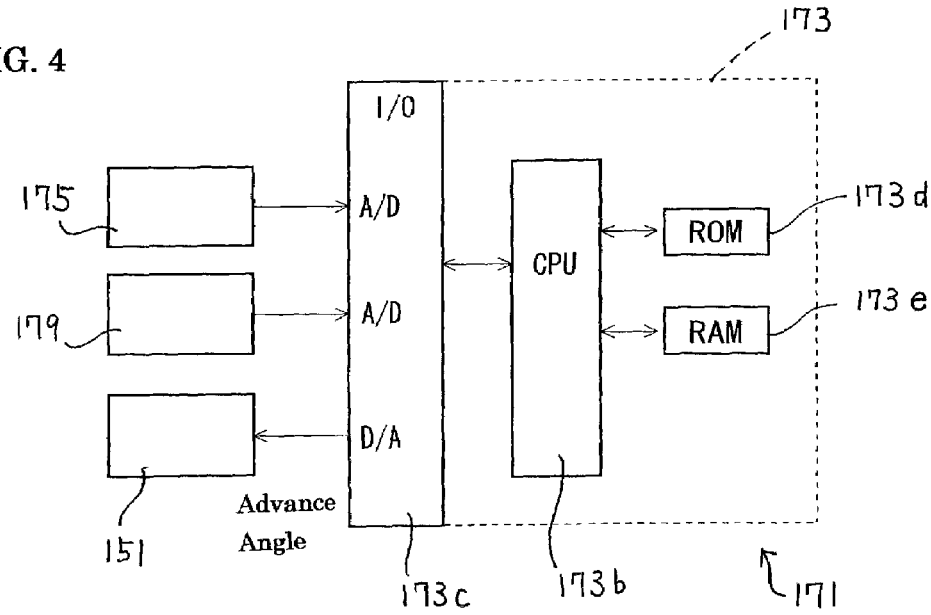
FIG. 4 is a system block diagram showing the structure of the advance angle determining section.

FIG. 4 is a system block diagram of the advance angle determining section 171. The advance angle determining IC 173 includes a CPU 173*b*, an I/O port 173*c*, ROM 173*d* and RAM 173*e*. These elements of the advance angle determining IC 173 are integrally provided in the form of chips. The battery voltage detecting section 175 and the battery current detecting section 179 are connected to the I/O port 173*c*. Advance angles are determined within the advance angle determining section 171, and then converted from digital to analog form within the I/O port 173*c* and thus, outputted to the DC brushless motor driving circuit 151.

According to the representative embodiment, the advance angle for the DC brushless motor 121 may be determined by utilizing an advance angle map 191. The advance angle map 191 is stored in the ROM 173*d* of the advance angle determining IC 173. FIG. 5 shows an example of the advance angle map 191. The advance angle map 191 (or ROM 173*d*) is a feature that corresponds to the element of "storing device" of the pre-determined advance angles according to the present teachings.

The advance angle map 191 stores advance angles determined in accordance with changes in battery voltage and current. Respective advance angles are provided in the form of mapping data defined by the combination of the battery voltage and the battery current. Battery voltages and currents are respectively divided into groups in specified increments. For example, battery voltages are divided into groups of "0" to "F" in hexadecimal notation, in 0.5V increments in the range between 9V and 17V. On the other hand, battery currents are divided into groups of "0" to "F" in hexadecimal notation, in 3 A increments in the range between 1 A and 51 A. Such divided voltages and currents are defined as 8 bits of data. With respect to the data, four most significant bits (MSB) and four least significant bits (LSB) are respectively provided. Thus, advance angles corresponding to the respective groups of divided voltages and currents are stored in the map 191. For example, when the voltage results 10.2V and the current results 2 A, the advance angle is set to 2.1° (degree). As it can be seen from the advance angle map 191 of FIG. 5, advance angles are set to decrease as battery voltages increase and to increase as battery currents increase.

In order to determine the advance angles, fall time "t" of the winding current of the coil with respect to the induced voltage is, for the first, calculated by using the equation "$t=L\times I/V$". In this equation, parameter "V", "I" and "L" represent the battery voltage, battery current and coil inductance, respectively. In this representative embodiment, value of the coil inductance "L" is arranged as 36 $\mu$H (micro Henry). Then, a switching (commutating) cycle "T" is calculated based upon the drive frequency "f" of the DC brushless motor 121 by using the equation "$f=1/T$". In this representative embodiment, value of the drive frequency "f" is arranged as 660 Hz (Hertz), so that the switching cycle "T" is calculated to be about 1500 $\mu$sec (micro second). Consequently, the advance angle "$\theta$" is calculated based upon the calculated current fall time "f" and cycle "T" by using the equation "$\theta=2\pi\times t/T$". Moreover, following these calculating procedures, advance angles are calculated so as to correspond to each of the battery voltages and currents. The calculated advance angles are stored as mapping data in the advance angle map 191 as shown in FIG. 5. In FIG. 5, only certain ranges of the advance angles are shown and remaining ranges are abbreviated for the sake of convenience.

As to the use of the representative screw driver 101, when the user of the screw driver 101 operates the trigger switch 113 as it is shown in FIG. 1, the DC brushless motor 121 is driven by the battery 141 that is used as a power source. The rotational movement of the DC brushless motor 121 is transmitted to the spindle 107 via the motor drive shaft 123, while being decelerated by the speed change mechanism 105. When the spindle 107 is thus rotated by the motor 121, the driver bit 111 coupled to the bit mounting chuck 109 on the front end of the spindle 107 is also rotated. Thus, the screw tightening operation can be performed.

Figure 6:
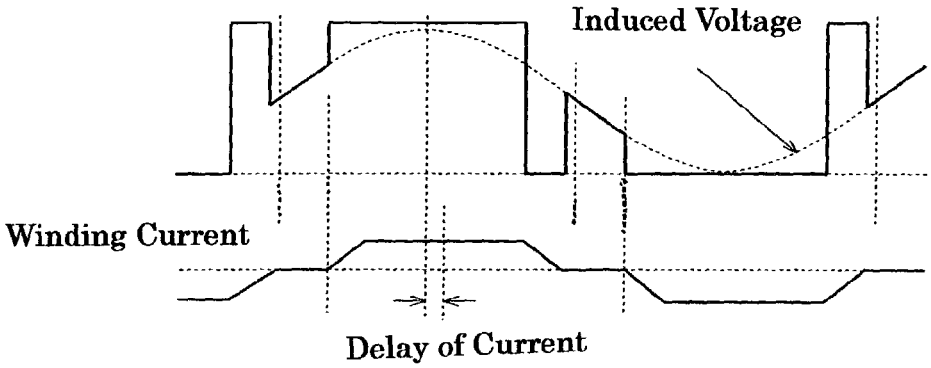
FIG. 6 shows a phase delay of the current with respect to the induced voltage within the brushless motor.

At this time, as it is shown in FIG. 6, the winding current within the DC brushless motor 121 may cause a phase delay (referred to as "delay of current" in the drawing) with respect to the induced voltage. Particularly, the operation of the power tool requires high torque output to the DC brushless motor of the power tool and therefore, such phase delay may frequently take place due to such requirement. Especially when a screw tightening operation is performed in the soft joint (see FIG. 9), it is difficult to utilize the inertia force of the rotating rotor or other similar force as additional screw tightening torque. Further, when the DC brushless motor is rotated in the reverse direction with higher torque, for example, in order to loosen screws which were incorrectly tightened to the work-piece or in order to loosen screws to which coating or adhesive material is applied. As the result of such situations, higher torque output is required to the DC brushless motor when the power tool is in operation. Alternatively or in addition, the DC brushless motor is required to continue to generate torque for a relatively long period of working time. Thus, a phase delay of the winding current with respect to the induced voltage tends to occur.

In order to alleviate or prevent such phase delay, the advance angle determining section 171 is adapted and arranged to detect the source voltage and current of the battery 141 by means of the battery voltage detecting section 175 and battery current detecting section 179. Further, based upon the detected battery source voltage and current, the advance angle determining section determines the optimum advance angle in accordance with the advance angle map 191 as shown in FIG. 5.

Figure 7:
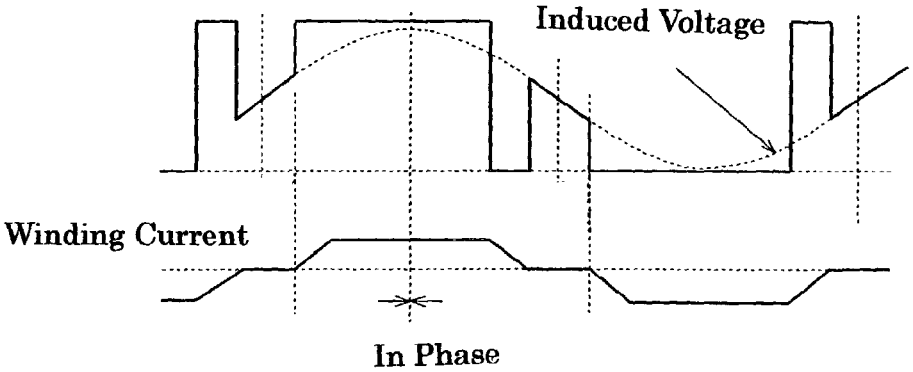
FIG. 7 shows a result of controlling the advance angle within the brushless motor.

The advance angle determining section 171 then inputs the determined optimum advance angle into the advance angle input section 153*b* of the DC brushless motor driving circuit 151. The DC brushless motor driving circuit 151 controls the advance angle of the DC brushless motor based on the inputted advance angle. As a result of such control, a phase delay of the winding current with respect to the induced voltage can be alleviated or eliminated. Specifically, as shown in FIG. 7, the winding current is brought in phase with the induced voltage.

Figure 8:
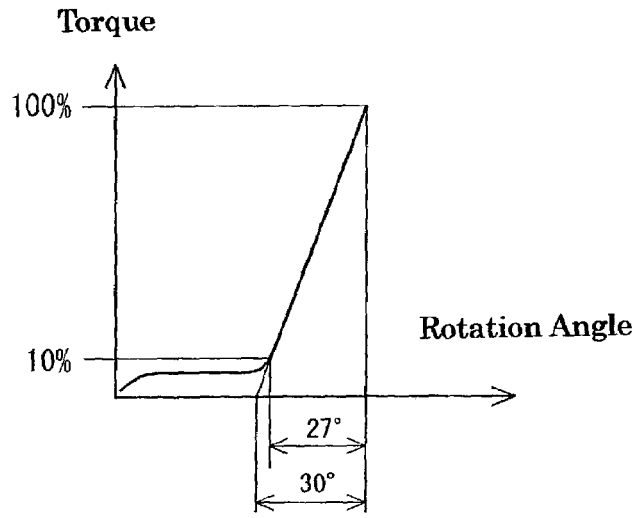
FIG. 8 is a graph showing the relationship between the rotational angle of the screw and the measured torque when a screw tightening operation is performed as hard joint.
Figure 9:
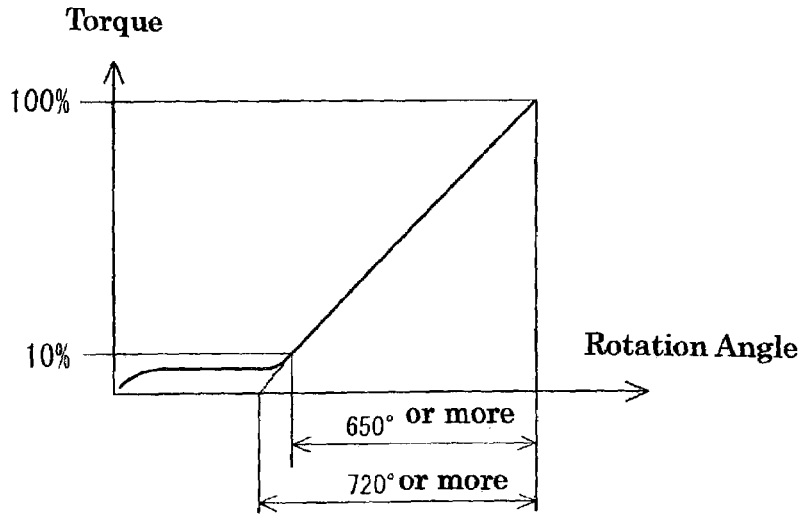
FIG. 9 is a graph showing the relationship between the rotational angle of the screw and the measured torque when a screw tightening operation is performed as soft joint.

According to the representative embodiment, the DC brushless motor 121 is controlled by accurately determining an advance angle based on the battery voltage and current. Therefore, the DC brushless motor 121 can be accurately controlled in response to changes of torque requirement during operation of the screw driver 101. Further, the DC brushless motor 121 can be accurately controlled in response to various factors such as internal resistance and operating conditions of the battery, which affect the motor output characteristics of the power tool. As a result, the DC brushless motor 121 can be operated with higher efficiency even in a screw tightening operation in the soft joint as shown in FIG. 9, as well as a screw tightening operation in the hard joint as shown in FIG. 8, and also during the reverse rotation of the motor in which a relatively high torque tends to be required.

Further, according to the representative embodiment, because motor operating efficiency in the screw tightening operation in the soft joint can be increased, the mean shift can be minimized. In other words, a difference between the measured torque in the hard joint and the measured torque in the soft joint can be minimized.

Although, FETs are used in the above described embodiment, transistors may be used instead of the FETs.

In the representative embodiment, the advance angle map 191 is adapted and arranged to store advance angles determined in accordance with the battery voltage and current. However, without providing such map, it may be designed such that an optimum advance angle can be calculated in real time during operation of the power tool. In such case, the advance angles may be sequentially calculated. Alternatively, the battery voltage and current (or indexes which reflect them) may be measured at pre-determined sampling time intervals, and optimum advance angles in the sampling time may be calculated based upon the measured battery voltage and current.

Although, in the above-mentioned embodiment, the DC brushless motor driving circuit 151 and the advance angle determining section 171 have respective separate ICs, the two ICs may be integrated into one IC.

I claim:

1. A power tool comprising:

a tool bit;

a brushless motor having a rotor, wherein the motor drives the tool bit by rotation of the rotor;

a battery detachably coupled to the power tool, wherein the battery provides direct current to the brushless motor; and a control device to operate the brushless motor via the battery, wherein the control device includes an advance angle controlling section to control an advance angle of the brushless motor based upon indexes that reflect a working condition of the tool bit when the brushless motor operates, the advance angle indicating phase differences between an induced voltage and a winding current, thereby improving the output efficiency of the power tool based upon said indexes in relation to voltage and current of the battery during operation of the brushless motor, wherein the control device operates the brushless motor so as to decrease a difference between the measured torque in hard joint operation in which the tool bit rotates by first angle until a tightening operation by the tool bit is completed and the measured torque in soft joint operation in which the tool bit rotates by second angle which is smaller than the first angle until a tightening operation by the tool bit is completed.

2. The power tool as defined in claim 1, wherein the control device includes an advance angle controlling section that controls so that the advance angle decreases as battery voltages increase and increases as battery currents increase.

3. A power tool comprising:

a tool bit, a brushless motor having a rotor, wherein the motor drives the tool bit by rotation of the rotor, a battery detachably coupled to the power tool, wherein the battery provides direct current to the brushless motor, and means for controlling the brushless motor by utilizing the battery, wherein the control means includes an advance angle controlling section to control an advance angle of the brushless motor based upon indexes that reflect working condition of the tool bit when the brushless motor operates, the advance angle indicating phase differences between an induced voltage and a winding current, thereby improving the output efficiency of the power tool based upon said indexes in relation to voltage and current of the battery during operation of the brushless motor, wherein the control means operates the brushless motor so as to decrease a difference between the measured torque in hard joint operation in which the tool bit rotates by first angle until a tightening operation by the tool bit is completed and the measured torque in soft joint operation in which the tool bit rotates by second angle which is smaller than the first angle until a tightening operation by the tool bit is completed.

4. The power tool as defined in claim 3, wherein the control means includes an advance angle controlling section that decreases the advance angle as battery voltages increases and the advance angle controlling section increases the advance angle as battery currents increases.

* * * * *